United States Patent [19]

Pettersson et al.

[11] 4,449,573

[45] May 22, 1984

[54] REGENERATIVE HEAT EXCHANGERS

[75] Inventors: Birger Pettersson, Älta; Kurt Karlsson, Tyresö, both of Sweden

[73] Assignee: Svenska Rotor Maskiner Aktiebolag, Nacka, Sweden

[21] Appl. No.: 373,434

[22] Filed: Apr. 30, 1982

Related U.S. Application Data

[63] Continuation of Ser. No. 38,567, May 14, 1979, abandoned, which is a continuation of Ser. No. 785,586, Apr. 7, 1977, abandoned, which is a continuation of Ser. No. 641,307, Dec. 16, 1975, abandoned, which is a continuation of Ser. No. 473,823, May 28, 1974, abandoned, which is a continuation of Ser. No. 176,141, Aug. 30, 1971, abandoned, which is a continuation-in-part of Ser. No. 45,135, Jun. 10, 1970, abandoned.

[30] Foreign Application Priority Data

Jun. 16, 1969 [GB] United Kingdom ..... 30314/69
Nov. 2, 1970 [GB] United Kingdom ..... 51926/70

[51] Int. Cl.[3] ..... F28D 19/04
[52] U.S. Cl. ..... 165/10; 165/5
[58] Field of Search ..... 165/10, 5, 166, 167

[56] References Cited

U.S. PATENT DOCUMENTS

| | | | |
|---|---|---|---|
| 2,023,965 | 12/1935 | Lysholm | 165/10 |
| 2,064,931 | 12/1936 | Lysholm | 165/10 X |
| 2,438,851 | 3/1948 | Gates | 165/10 |
| 2,596,642 | 5/1952 | Boestad | 165/10 |
| 2,777,674 | 1/1957 | Wabeman | 165/167 |
| 2,787,446 | 4/1957 | Ljungstrom | 165/167 |
| 2,940,736 | 6/1960 | Odman | 165/10 |
| 2,946,573 | 7/1960 | Lindhagen et al. | 165/10 |
| 3,183,963 | 5/1965 | Mondt | 165/10 |
| 3,216,494 | 11/1965 | Goodman | 165/166 |

FOREIGN PATENT DOCUMENTS

| | | | |
|---|---|---|---|
| 259699 | 11/1963 | Australia | 165/10 |
| 525154 | 5/1956 | Canada | 165/10 |
| 525153 | 5/1956 | Canada | 165/10 |
| 759598 | 11/1933 | France | 165/10 |
| 253573 | 3/1948 | Switzerland | 165/166 |
| 899773 | 6/1962 | United Kingdom | 165/10 |

*Primary Examiner*—Albert W. Davis, Jr.
*Attorney, Agent, or Firm*—Frishauf, Holtz, Goodman and Frishauf

[57] ABSTRACT

A pack of heat transfer plates for regenerative heat exchangers comprising superimposed profiled plates. Each plate is provided with spaced parallel double ridges protruding symmetrically from both sides of the plate and extending obliquely relatively to the general direction of the fluid flow through the pack. The plates are disposed such that the ridges of one plate lie transverse to the ridges of adjacent plates so that the plates are in contact with each other solely at points spaced along the crests of the ridges.

27 Claims, 6 Drawing Figures

REGENERATIVE HEAT EXCHANGERS

CROSS-REFERENCE TO RELATED APPLICATION

This is a continuation of application Ser. No. 038,567 filed May 14, 1979, (now abandoned) which is a continuation of Ser. No. 785,586 filed Apr. 7, 1977 (now abandoned), which is a continuation of Ser. No. 641,307 filed Dec. 16, 1975 (now abandoned), which in turn is a continuation of Ser. No. 473,823 filed May 28, 1974 (now abandoned), which is a continuation of U.S. Ser. No. 176,141, filed Aug. 30, 1971, (now abandoned) which is a continuation-in-part of U.S. Ser. No. 45,135, filed June 10, 1970, now abandoned.

BACKGROUND OF THE INVENTION

The invention relates to regenerative heat exchangers and more particularly to the regenerative mass of such heat exchangers.

Regenerative heat exchangers of the rotary type are commonly used as air preheaters in boiler plants and in most cases the regenerative mass of the preheater consists of profiled plates carried by an annular regenerator body and arranged such as to form channels for the heat exchanging fluids which channels extend between the axially opposite ends of the body. There are two main types of rotary air preheaters, one having a rotatable regenerative mass and stationary ducts for the heat exchanging fluids and the other having a stationary regenerative mass and rotatable ducts for the fluids.

Already at an early stage of the development of the rotary regenerative heat exchanger it was found that it was necessary to use profiled plates in order to increase the heat transfer between the fluids and the plates to an acceptable level. Thus, during the past decennia there have been proposed several plate shapes. In modern regenerative heat exchangers the regenerative mass is most frequently composed of plates which are provided with undulations or corrugations extending obliquely relatively to the main direction of fluid flows through the mass and the plates are further provided with ridges which are parallel with said main flow direction and serve as spacers between adjacent plates. Such undulated and ridged plates alternate with plane or undulated plates to form channels for the fluid flows to which is imparted a certain turbulence by the undulations.

In air preheaters of the regenerative type air and flue gases pass in countercurrent relationship through the regenerative mass. Thereby the temperature of the mass becomes much higher at the gas inlet and air outlet end than at the gas outlet and air inlet end. During operation it is of course desirable to extract as much heat as possible from the gases. However, if the temperature of the gases reaches the dew point corrosive moisture is deposited on the surfaces of the plates resulting in rapid destruction of the sheet metal if it is not corrosion resisting in itself or protected against corrosion.

It has proved that corrosion may occur here and there at the cold end of the regenerative mass even though the temperature of the gases in the outlet duct has never dropped to the dew point. It has been found that this local corrosion is caused by an uneven distribution of the fluid flows in the separate channels or groups of channels. If, for instance, due to the oblique undulations the gas flow gets a tendency to concentrate at one side of the channel the air flow gets a corresponding tendency to concentrate at the other side of the channel. This results in an uneven temperature distribution in the gas flow leaving the channel so that the temperature at one side is above and at the other side may lie at or below the dew point but nevertheless the average temperature of the flow may lie well above the dew point.

One object of the invention is to provide a pack of heat transfer plates for regenerative heat exchangers which is composed of identically profiled plates.

Another object of the invention is to provide a plate pack in which the temperature of the plate portions defining a channel is substantially constant along the perimeter of the cross section of the channel at least at the cold end of the regenerative mass.

DETAILED DESCRIPTION

Figure 1:
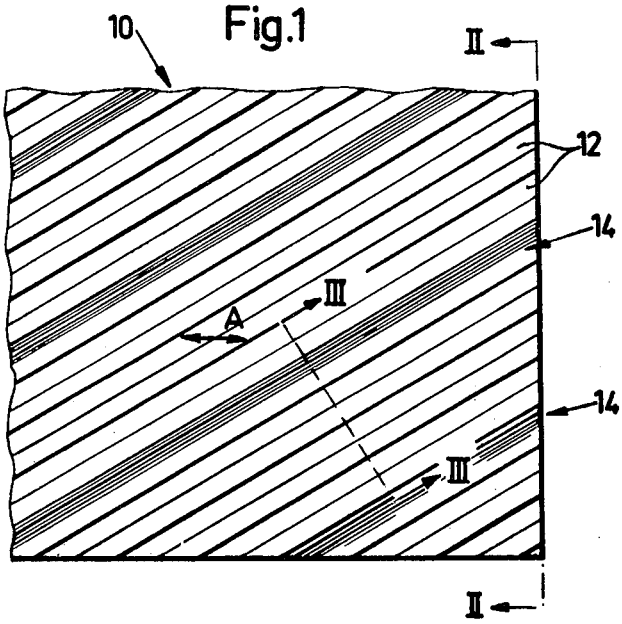
FIG. 1 is a plan view of a heat transfer plate for a plate pack according to the invention.
Figure 2:
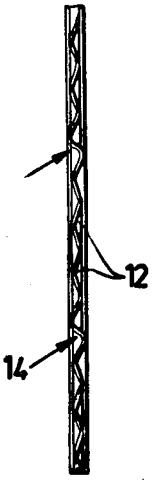
FIG. 2 is an end view of the plate as seen from line II—II in FIG. 1.

In FIG. 1 a heat transfer plate is generally indicated by numeral 10. The plate is provided with separating plate portions 15 having undulations 12 over their whole surfaces which extend obliquely relatively to the main direction of fluid flow through the plate pack which direction is indicated by the double arrow A in FIG. 1.

The plate 10 is further provided with evenly spaced double ridges 14 which are parallel with the undulations 12 and spaced apart a distance corresponding to the combined width of several undulations. The ridges protrude symmetrically from both sides of the plate and the height of the ridges over the middle plane B of the plate (FIG. 3) is greater than that of the undulations.

Figure 3:
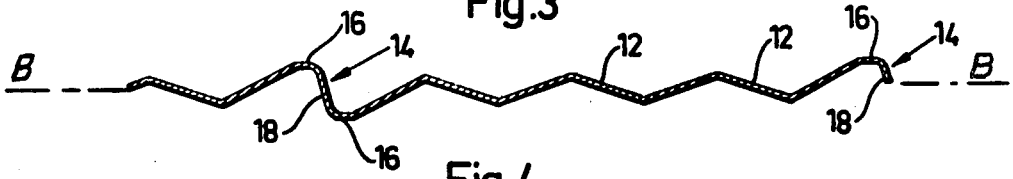
FIG. 3 is a cross-sectional view taken along line III—III in FIG. 1.

As shown in FIG. 3 the crests of the ridges 14 are flattened at 16 to provide for surface contact between the crests of the ridges of adjacent plates in the plate pack. The steeply stoping intermediate web portions 18 of the ridges 14 may be substantially perpendicular to the middle plane B of the plate in order most effectively to resist the contact pressure between the plates of a pack. However, in order to facilitate the manufacture of the plates the web portions 18 may be given an inclination of 70°–80° relative to the median plane of the plate without appreciably reducing the strength and stiffness of the plate. Each ridge of the double ridges 14 has a respective outer wall 17, 19 which extends to the undulated plate portions 12 adjacent the respective crest, the outer walls 17, 19 symmetrically sloping relative to said separating plate portion and having a substantially lower slope relative to the median plane of the plate than the intermediate web portion 18.

Figure 4:
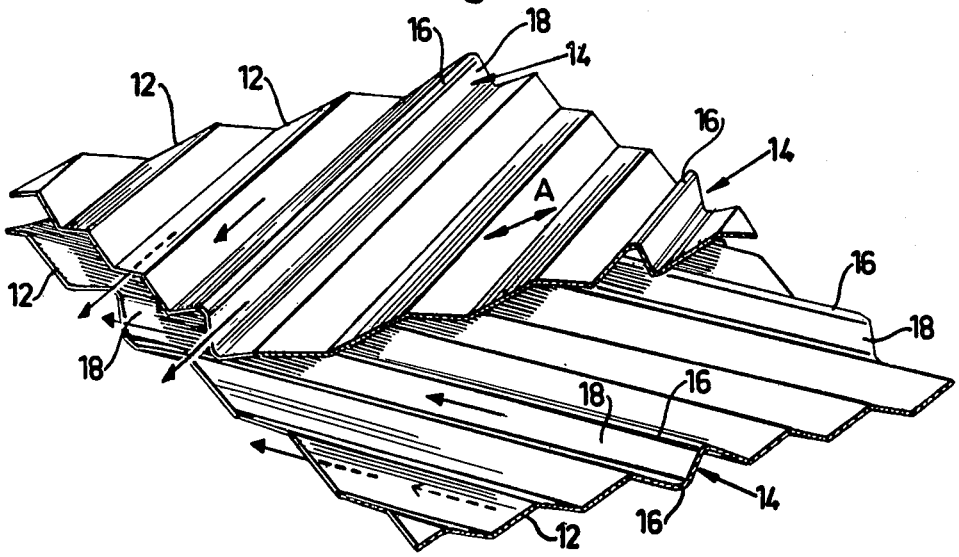
FIG. 4 is a perspective view of two superimposed heat transfer plates illustrating the channel system of a plate pack according to the invention and FIGS. 5 and 6 illustrate in a similar manner as FIGS. 3 and 4, respectively, a simplified embodiment of the invention.

FIG. 4 illustrates the channel system formed by the plates in the finished plate pack or bundle. Each plate pack contains a large number of superimposed plates but in FIG. 4 only two plates 10 are shown.

All plates of a pack are of the same profile but the plates are positioned such that the undulations and ridges of one plate cross the undulations and ridges of adjacent plates. In this manner the plates are in contact with each other solely at points spaced along the crests of the ridges.

In order to facilitate the understanding of the invention first assume that the present invention is modified by adding a flat separating plate between the two plates shown in FIG. 4, thereby subdividing the space between the profiled plates into two portions each forming a system of straight parallel channels. These two systems cross each other and the fluid flows in the channels are undisturbed of each other. However, in the plate pack according to the present invention there are no such flat separating plates and therefore the flows in the two channel systems interfere with each other so that the flows mingle with each other and become whirling and turbulent whereby the boundary layers are reduced and the heat transfer is increased.

In the embodiment shown in FIG. 4 the undulations and ridges of adjacent plates extend symmetrically obliquely in opposite directions relatively to the main direction of fluid flow indicated by the double arrow A. Thereby is attained that a fluid flow passing through the plate pack is deflected laterally alternately in both directions to substantially the same degree so that it has no tendency to concentrate at the one or other side of the pack. Therefore, the flow leaving the pack is substantially uniform over its whole cross-sectional area.

In the embodiment described the undulations and ridges form an angle with the main direction of fluid flow of 30° but dependent on the specific requirements in each separate case the angle may be given any value between 20° and 50°. The difference between the heights of the ridges and the undulations over the middle plane B of the plate may amount to about 1.0 to 1.8 mm and preferably has a magnitude of substantially 1.25 mm. The height of the undulations over the middle plane may amount to about 1.0 to 2.0 mm and good results have been obtained with plates made from sheet metal of a thickness of 0.5 mm in which the height of the undulations was 1.25 mm. The pitch of the undulations may lie within the range of 12 to 20 mm and amount to for instance 15 mm and the pitch of the ridges may have a value of 50 to 100 mm.

Figure 5:
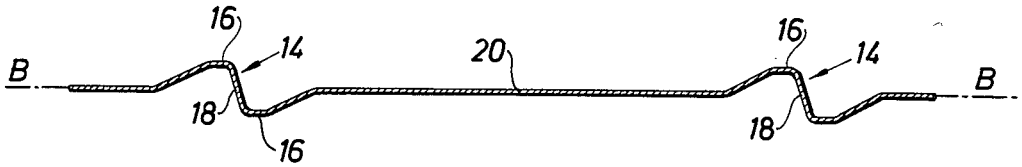
Figure 6:
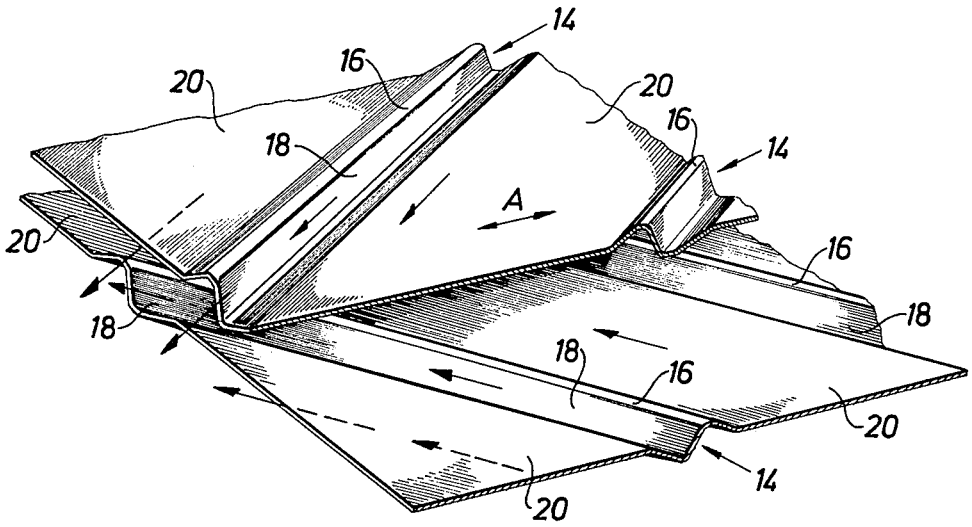
Figure 5:
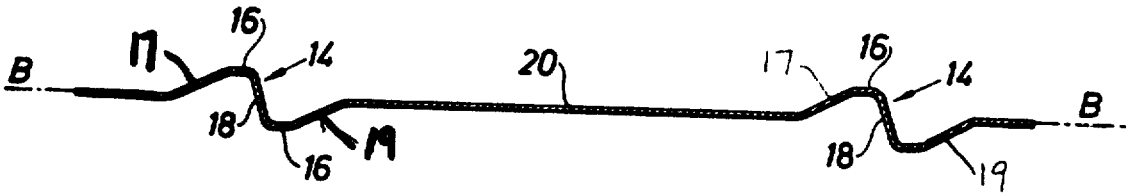
Figure 6:
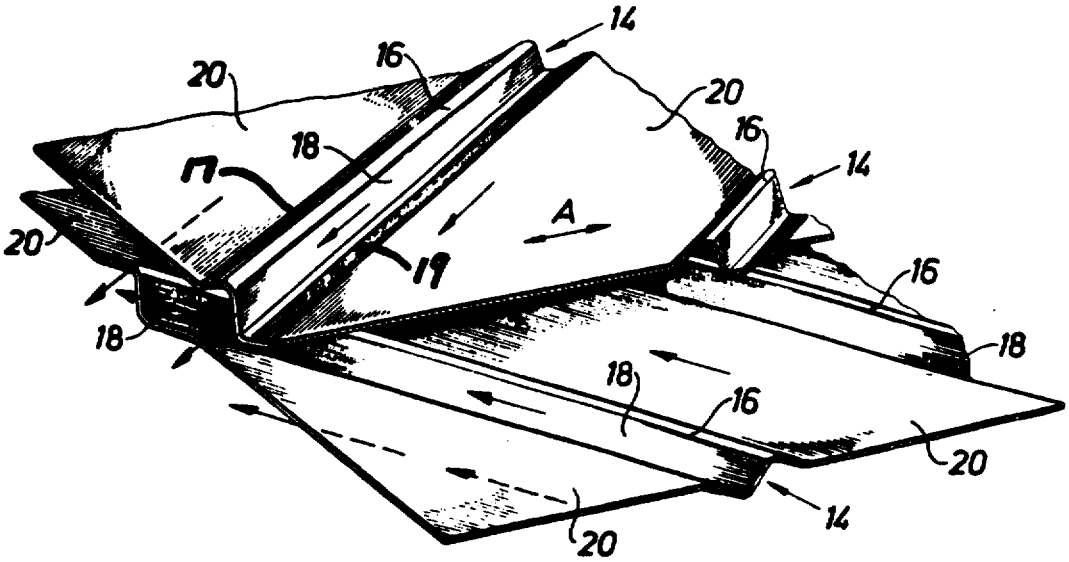

The embodiment according to FIGS. 5 and 6 differs from the embodiment just described mainly by the fact that the undulations 12 are omitted. Thus, the plate portions 20 between the ridges 14 are flat and their width is greater than the height of the ridges 14 above the median plane B of the plate (FIG. 5). Said height may amount to between about 1.5 to about 4 mm and preferably has a magnitude of substantially 2.0 mm. The distance between the ridges may have a value of about 30 to about 60 mm and the ridges may form an angle with the general direction of fluid flow of between 15° and 35°. The thickness of the sheet metal may amount to between 0.5 mm and 1.0 mm.

We claim:

1. A pack of heat transfer plates for regenerative air preheaters comprising a plurality of superimposed profiled plates, each pair of plates together forming elongated, substantially straight open-ended channels for substantially free flow therethrough in either direction of heat exchanging fluids substantially without deflecting the straight flowing heat exchanging fluids flowing through said open-ended channels from their substantially straight flow path, said channels extending between two opposite end surfaces of the pack and being closed on their sides by said pair of adjacent plates, each plate being provided with a plurality of spaced sets of straight continuous parallel double ridges extending obliquely to said end surfaces from one edge of the plate to another, the double ridges of each set having opposed crests protruding symmetrically from both opposite sides of each of said plates, adjacent sets of double ridges of each of said plates being separated by separating plate portions of a width greater than the height of said double ridges above the median plane of the plate, said double ridges each having an interior wall defined by an intermediate contact pressure resisting web portion joining the opposed crests of the double ridge, said intermediate web portion being steeply sloping relative to said median plane of the plate to effectively resist the contact pressure between said superimposed plates, each ridge of said double ridges having an outer wall which extends from the respective crest to the separating plate portion adjacent the respective crest, said outer walls symmetrically sloping relative to said separating plate portion and having a substantially lower slope relative to said median plane than said intermediate web portion, said separating plate portions being provided with undulations substantially parallel with the ridges, said undulations having a ratio of undulation height over the middle plane of the plate to undulation pitch amounting to 0 to 1/6, and said plates being so disposed relative to each other that the ridges of one plate lie transverse to the ridges of adjacent plates so that the ridges of the adjacent plates cross each other at respective crossing portions of the crests of the ridges thereof, and said adjacent plates supporting each other solely by direct contact at the crossing portions of the crests of the ridges to form said flow channels between adjacent plates, the angle between the ridges and said end surfaces of the plate pack being between 40° and 75°, and being smaller than 75° when said ratio is equal to 0 and smaller than 70° when said ratio is greater than 0, whereby each time a heat exchanging fluid flowing in a given flow channel reaches a crossing portion of the crests of the ridges of adjacent plates, the fluid is split up into sub-flows, one sub-flow portion flowing to an adjacent flow channel to at least partly be mixed with the fluid of said adjacent flow channel, and another sub-flow portion remaining in said given flow channel.

2. A plate pack according to claim 1 in which the crests of the ridges of each plate are flattened to provide surface contact between the crests.

3. A plate pack according to claim 1 wherein the crossings of the crests of the ridges of adjacent plates are randomly located.

4. A plate pack according to claim 1 in which all the plates are of the same profile.

5. A plate pack according to claim 1 wherein said intermediate web portion forms an angle of about 70°–80° with the said median plane of said plate.

6. A plate pack according to claim 1 in which the angle between the ridges and said end surfaces is from about 55° to 75°.

7. A plate pack according to claim 1 in which the height of the ridges above the median plane of the plate is from about 1.5 to about 4.0 mm.

8. A plate pack according to claim 1 in which the pitch of the ridges lies between about 30 to about 60 mm.

9. A plate pack according to claim 1 in which the angle between the undulations and ridges and said end surfaces of the plate pack is from about 40° to 70°.

10. A plate pack according to claim 1 in which the difference between the heights of the ridges and the undulations over the middle plane of the plate is from about 1.0 to 1.8 mm.

11. A plate pack according to claim 1 in which the height of the undulations over the middle plane of the plate is from about 1.0 to 2.0 mm.

12. A plate pack according to claim 1 in which the pitch of the undulations is from about 12 to 20 mm.

13. A plate pack according to claim 1 in which the pitch of the ridges is from about 50 to 100 mm.

14. A pack of heat transfer plates for regenerative air preheaters comprising a plurality of superimposed profiled plates, each adjacent pair of plates together forming elongated, substantially straight open-ended channels for substantially free flow therethrough in either direction of heat exchanging fluids substantially without deflecting the straight flowing heat exchanging fluids flowing through said upper-ended channels from their substantially straight flow path, said channels extending between two opposite end surfaces of the pack and being closed on their sides by said pair of adjacent plates, each plate being provided with a plurality of spaced sets of straight continuous parallel double ridges extending obliquely to said end surfaces from one edge of the plate to another, the double ridges of each set having opposed crests protruding symmetrically from both opposite sides of each of said plates, adjacent sets of double ridges of each of said plates being separated by substantially flat plate portions of a width greater than the height of said double ridges above the median plane of the plate, said double ridges each having an interior wall defined by an intermediate contact pressure resisting web portion joining the opposed crests of the double ridge, said intermediate web portion being steeply sloping relative to said substantially flat portions to effectively resist the contact pressure between said superimposed plates, each ridge of said double ridges having an outer wall which extends from the respective crest to the flat plate portion adjacent the respective crest, said outer walls symmetrically sloping relative to said flat plate portion and having a substantially lower slope relative to said flat plate portions than said intermediate web portion, and said plates being so disposed relative to each other that the ridges of one plate lie transverse to the ridges of adjacent plates so that the ridges of the adjacent plates cross each other at respective crossing portions of the crests of the ridges thereof, and said adjacent plates supporting each other solely by direct contact at the crossing portions of the crests of the ridges to form said flow channels between adjacent plates, the angle between the ridges and said end surfaces of the plate pack being between 40° and 75°, whereby each time a heat exchanging fluid flowing in a given flow channel reaches a crossing portion of the crests of the ridges of adjacent plates, the fluid is split up into sub-flows, one sub-flow portion flowing to an adjacent flow channel to at least partly be mixed with the fluid of said adjacent flow channel, and another sub-flow portion remaining in said given flow channel.

15. A plate pack according to claim 14 wherein the angle between the ridges and said end surfaces of the plate pack is from about 55° to 75°.

16. A plate pack according to claim 14 wherein the height of the ridges of the median plane of the plate is from about 1.5 to about 4 mm.

17. A plate pack according to claim 16 wherein the pitch of the ridges lies between about 30 to about 60 mm such that the ratio of the pitch of the ridges to the height of the ridges ranges from 7.5 to about 40.

18. A plate pack according to claim 14 wherein the pitch of the ridges lies between about 30 to about 60 mm.

19. A plate pack according to claim 14 in which the crests of the ridges of each plate are flattened to provide surface contact between the crests.

20. A plate pack according to claim 14 wherein the crossings of the crests of the ridges of adjacent plates are randomly located.

21. A plate pack according to claim 14 in which all the plates are of the same profile.

22. A plate pack according to claim 10 in which the height of the undulations over the middle plane of the plate is from about 1.0 to 2.0 mm.

23. A plate pack according to claim 11 in which the pitch of the undulations is from about 12 to 20 mm.

24. A plate pack according to claim 10 in which the pitch of the undulations is from about 12 to 20 mm.

25. A plate pack according to claim 11 in which the pitch of the ridges is from about 50 to 100 mm.

26. A plate pack according to claim 14 wherein said intermediate web portion forms an angle of about 70°–80° with the said median plane of said plate.

27. A plate pack according to claim 17 wherein said intermediate web portion forms an angle of about 70°–80° with the said median plane of said plate.

* * * * *

UNITED STATES PATENT AND TRADEMARK OFFICE

CERTIFICATE OF CORRECTION

PATENT NO. : 4,449,573

DATED : May 22, 1984

INVENTOR(S) : Birger PETTERSSON, et al

It is certified that error appears in the above—identified patent and that said Letters Patent is hereby corrected as shown below:

On the initial page of patent, under the heading "References Cited" and sub-heading "U.S. Patent Documents", change the fifth entry, USP 2,777,674, from "Wabeman" to --Wakeman--;

Column 2, line 49, after the words, "The steeply" change "stoping" to --sloping--.

Sheet 2 of 2 of the Drawings consisting of Figures 5 and 6 should be deleted to appear as per the attached sheet.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*